US007556123B2

(12) United States Patent
Ido et al.

(10) Patent No.: US 7,556,123 B2
(45) Date of Patent: Jul. 7, 2009

(54) MUFFLER DUCT

(75) Inventors: Yasushi Ido, Aichi-ken (JP); Masaru Hattori, Aichi-ken (JP)

(73) Assignee: Toyoda Gosei Co., Ltd., Aichi-pref. (JP)

( * ) Notice: Subject to any disclaimer, the term of this patent is extended or adjusted under 35 U.S.C. 154(b) by 18 days.

(21) Appl. No.: 11/819,543

(22) Filed: Jun. 28, 2007

(65) Prior Publication Data

US 2008/0041657 A1 Feb. 21, 2008

(30) Foreign Application Priority Data

Jun. 30, 2006 (JP) ..... 2006-181509

(51) Int. Cl.
*F01N 1/02* (2006.01)
*F01N 1/22* (2006.01)
*F02M 35/10* (2006.01)
*F01N 1/00* (2006.01)

(52) U.S. Cl. ..... 181/255; 181/250; 181/276; 123/184.57

(58) Field of Classification Search ..... 181/255, 181/250, 249, 266, 273, 276; 123/184.57, 123/184.53
See application file for complete search history.

(56) References Cited

U.S. PATENT DOCUMENTS 2,233,341 A * 2/1941 Cary ..... 181/250
2,297,046 A * 9/1942 Bourne ..... 181/250
3,396,812 A * 8/1968 Wilcox et al. ..... 181/250
4,038,820 A * 8/1977 Tsukamoto ..... 60/314
4,892,168 A * 1/1990 Sasaki et al. ..... 181/250
5,493,080 A * 2/1996 Moss ..... 181/232
5,762,858 A * 6/1998 Maeda et al. ..... 264/516
5,783,780 A * 7/1998 Watanabe et al. ..... 181/229
6,155,224 A * 12/2000 Akihisa et al. ..... 123/184.57
6,558,137 B2 * 5/2003 Tomell et al. ..... 417/312
6,622,680 B2 * 9/2003 Kino et al. ..... 123/184.21
6,938,601 B2 * 9/2005 Fukumoto ..... 123/184.57
2005/0205041 A1 * 9/2005 Moenssen et al. ..... 123/184.61

FOREIGN PATENT DOCUMENTS

JP 59034419 A * 2/1984
JP A-05-163925 6/1993
JP 05240120 A * 9/1993

* cited by examiner

*Primary Examiner*—Edgardo San Martin
(74) *Attorney, Agent, or Firm*—Posz Law Group, PLC

(57) ABSTRACT

In a muffler duct including a duct body and a resonance box, the inside of the duct body and the inside of the resonance box are made to communicate directly with each other not through a cylindrical member. In the partition wall of the resonance box, a gas vent opening portion, which is composed of a gas vent opening having a through hole shape and a gas-permeable member having a gas vent passage of a labyrinth shape for covering said gas vent opening, is formed at a position to confront a communication opening, through which the inside of the duct body and the inside of the resonance box communicate with each other.

12 Claims, 7 Drawing Sheets

MUFFLER DUCT

BACKGROUND OF THE INVENTION

1. Field of the Invention

The present invention relates to a duct, which can be used as the intake pipe of an internal combustion engine, for example.

2. Related Art

The muffler duct is used as an intake pipe or an exhaust pipe of an internal combustion engine or an air-conditioning apparatus. This muffler duct reduces the propagation sounds to propagate from a noise source such as the internal combustion engine or the air-conditioning apparatus, or the noises which are caused by its own intake pulsations. As the known muffler duct (as referred to JP-A-5-163925, for example), a muffling device (e.g., the so-called "Helmholtz resonator"), which is composed of a box-shaped resonance box and a cylindrical member (or a communicating tube), is connected to a cylindrical duct body.

In the muffler duct of this kind, the muffling device resonates with a predetermined frequency component (or a resonance frequency F) of the noises thereby to lower the sound pressure level in the resonance frequency F. It is known that the resonance frequency F is expressed by the following Formula 1.

$$F=(C/2\pi)\{\pi r^2/V(L+1.6r)\}^{1/2}. \quad \text{[Formula 1]}$$

Here: C indicates a sound velocity (cm/second); r the radius (cm) of a communicating tube; V a volume ($cm^3$) of a resonance box; and L a length (cm) of the communicating tube.

Here, it is widely known that mainly the noises of the low frequency make the user feel uncomfortable. It is, therefore, thought that the uncomfortable feel to be given to the user can be drastically reduced if the muffling device is designed to lower the resonance frequency F (or to make a low frequency). In order to lower the resonance frequency F, at least one of the volume V of the resonance box and the length L of the communicating tube may be enlarged according to the Formula 1. If the length L of the communicating tube is enlarged, however, the muffling device is enlarged to increase the bulk of the muffler duct. This raises a problem to make it difficult to mount the muffler duct on a vehicle or the like. If the volume of the resonance box is increased, on the other hand, an anti-resonance (or an anti-resonance) phenomenon may raise the sound pressure level in a specific frequency component.

JP-A-5-163925 has introduced the technique, in which the resonance frequency F is tuned by forming a plurality of openings in the partition wall of the resonance box. According to this technique, however, it is possible to lower only the noises of a frequency near the resonance frequency F but not the noises of the low frequency over a wide range.

SUMMARY OF THE INVENTION

The invention has been conceived in view of the background thus far described, and has an object to provide a muffler duct, which can reduce the noises of a low frequency without needing any long communicating tube and can reduce the noises of the low frequency over a wide range.

In order to solve the aforementioned problems, according to the invention, there is provided a muffler duct comprising: a duct body of a cylindrical shape having its inside and outside defined by a circumferential wall; and a resonance box of a box shape having its inside and outside defined by a partition wall and mounted on said duct body. The muffler duct is characterized in that a gas vent opening portion including a gas vent opening having a through hole shape and a gas-permeable member having a gas vent passage of a labyrinth shape for covering said gas vent opening is formed in said partition wall, in that said resonance box houses a portion of said duct body therein, in that said circumferential wall has a communication opening of a through hole shape opened in said resonance box, in that the inside of said duct body and the inside of said resonance box communicated directly with each other not through a cylindrical member but through said communication opening, and in that said communication opening is formed in said partition wall at a position to confront said communication opening.

It is preferred that the muffler duct of the invention is provided with at least one of the following (1) and (2):

(1) said resonance box encloses said duct body in the circumferential direction at an axial portion of said duct body; and (2) said resonance box extends along the axial direction of said duct body.

Unlike the general muffler duct, the muffler duct of the invention does not have a cylindrical member, i.e., a communicating tube. This makes the muffler duct of the invention unbulky.

Moreover, the muffler duct of the invention can reduce the noises of a low frequency over a wide range. The reason for this reduction is not defined but seems to have some relation to the facts that the muffler duct of the invention does not have any communicating tube, and that the inside of the duct body and the inside of the resonance box communicate directly with each other.

In the muffler duct of the invention, the gas vent opening of the through hole shape is formed in the partition wall of the resonance box. As a result, the inside and the outside of the resonance box communicate with each other through the gas vent opening. In the muffler duct of the invention, therefore, the sound pressure inside of the resonance box becomes lower. Therefore, the anti-resonance phenomenon can be suppressed. Moreover, the communication opening is covered with the gas-permeable member. Since the gas vent opening is covered with the gas-permeable member, the noises, which might otherwise leak out from the inside of the resonance box, are reduced.

If the gas vent opening is formed in the resonance box of the muffler duct, as described in the aforementioned JP-A-5-163925, the inside and the outside of the resonance box communicate with each other through the gas vent opening. Thus, it is possible to shift the resonance frequency F (or to tune the resonance frequency F). In this case, however, it is possible to reduce the noises near the resonance frequency tuned. However, the sound pressure level in a frequency higher and lower than the frequency of the reduced noises rises so that the noises of the low frequency cannot be reduced over the wide range. On the contrary, the muffler duct of the invention can reduce the noises not only near the resonance frequency F calculated on the basis of the aforementioned Formula 1 but also over the wide range. This reason is not defined but is thought to relate to the facts that the gas vent opening of the resonance box is covered with the gas-permeable member having the gas vent passage, and that the gas-permeable member has the gas vent passage of a labyrinth shape. In the muffler duct of the invention, the gas-permeable member has the gas vent passage having the labyrinth shape so that the air in the resonance box advances in the gas-permeable member while changing the direction complexly until it gently flows out to the outside.

In the muffler duct of the invention, moreover, the gas vent opening portion composed of the gas vent opening and the gas-permeable member is formed in the partition wall at a position to confront the communication opening. The communication opening is either the joint portion between the partition wall and the circumferential wall or the portion, which is formed in the circumferential wall and provides the communication between the inside of the duct body and the inside of the resonance box. The gas vent opening portion is formed in the partition wall at the position to confront the communication opening, so that the noises having propagated from the duct body to the resonance box easily reach the gas vent opening easily. Thus, the muffler duct of the invention can suppress the anti-resonance phenomenon more reliably.

Like the muffler duct introduced by JP-A-5-163925, specifically, the muffler duct of the invention has the opening (i.e., the gas vent opening portion) for providing the communication between the inside and the outside of the resonance box. Unlike the muffler duct introduced by JP-A-5-163925, however, the gas vent opening portion in the muffler duct of the invention contributes not to the tuning of the resonance frequency F but to the reduction of the anti-resonance phenomenon and the reliable reduction of the noises.

The muffler duct of the invention having the aforementioned (1) can shorten the distance between the communication opening and the gas vent opening portion. Therefore, it is possible to make the anti-resonance phenomenon less and to reduce the noises more reliably.

DETAILED DESCRIPTION OF THE PREFERRED EMBODIMENTS

Figure 1:
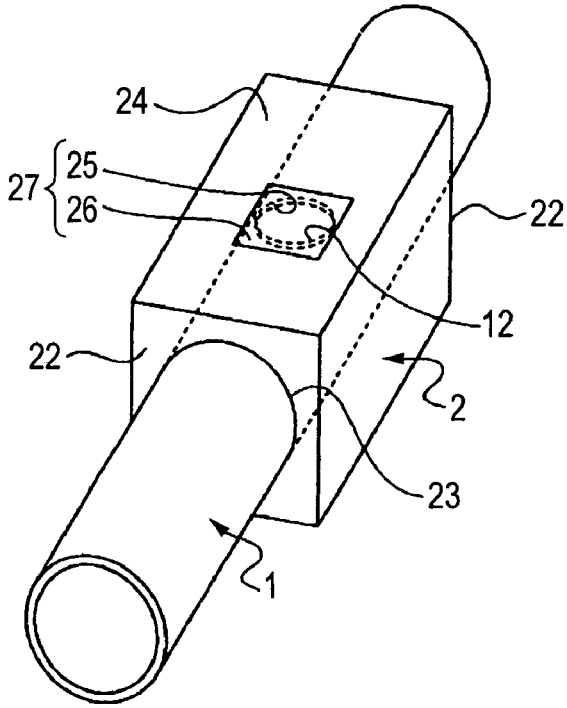
FIG. 1 is a perspective view showing the muffler duct of the embodiment schematically.

The volume of the resonance box in the muffler duct of the invention may be set according to the resonance frequency F to be eliminated, on the basis of the aforementioned Formula 1. In the muffler duct of the invention, the duct body is arranged outside of the resonance box. In the muffler duct of the invention, an axial portion of the duct body is housed in the resonance box. Therefore, the volume of the resonance box in the muffler duct of the invention indicates the volume of the space, which is defined by the inner periphery of the resonance box and the outer circumference of the duct body.

In the muffler duct of the invention, the inside of the duct body and the inside of the resonance box communicate directly with each other through the communication opening. In the muffler duct of the invention, therefore, the portion corresponding to the radius r of the communicating tube in Formula 1 is the radius of the communication opening. Like the volume of the resonance box, too, the radius of the communication opening may be set according to the resonance frequency F to be eliminated, on the basis of Formula 1. Here in the muffler duct of the invention, the portion corresponding to the length L of the communicating tube in Formula 1 becomes the length of the communication opening. The length of the communication opening in the muffler duct of the invention is the thickness of the circumferential wall. In the muffler duct of the invention, therefore, the length of the communication opening corresponding to the length L of the communicating tube is remarkably shortened.

The gas-permeable member may have the gas vent passage having the labyrinth shape but should not be especially limited in its material or shape. For example, the gas vent member may also be formed of nonwoven fabric of a resin material or sponge having pores of continuous foam type. If the gas-permeability of the gas-permeable member is excessively high, in addition to the aforementioned drawback, the sound waves in the resonance box transmit through the gas-permeable member so that they excessively leak to the outside. As a result, a preferable range exists in the gas-permeability of the gas-permeable member from the aspect of the balance between the noises to emanate to the outside through the duct body and the transmission sound to leak from the gas-permeable member to the outside. Specifically, it is preferred for the gas-permeability of the gas-permeable member that the gas vent of the air at the pressure difference of 98 Pa between the inside and the outside of the resonance box is 6,000 $m^3/h$ or less per 1 $m^2$. It is more preferred that the gas-permeability of the air at the pressure difference of 98 Pa between the inside and the outside of the resonance box is less than 4,200 $m^3/h$ per 1 $m^2$. It is still more preferred that the gas-permeability of the air at the pressure difference of 98 Pa between the inside and the outside of the resonance box is more than 0 $m^3/h$ and less than 3,000 $m^3/h$ per 1 $m^2$.

Embodiment

A muffler duct of the invention is described in the following with reference to the accompanying drawings.

Embodiment

The muffler duct of the embodiment is provided with the aforementioned (1) and (2). A perspective view expressing the muffler duct of the embodiment schematically is shown in FIG. 1. On the other hand, FIG. 2 is a sectional view schematically showing the behavior, in which the muffler duct of the embodiment is cut in parallel with the radial direction of the duct body.

Figure 2:
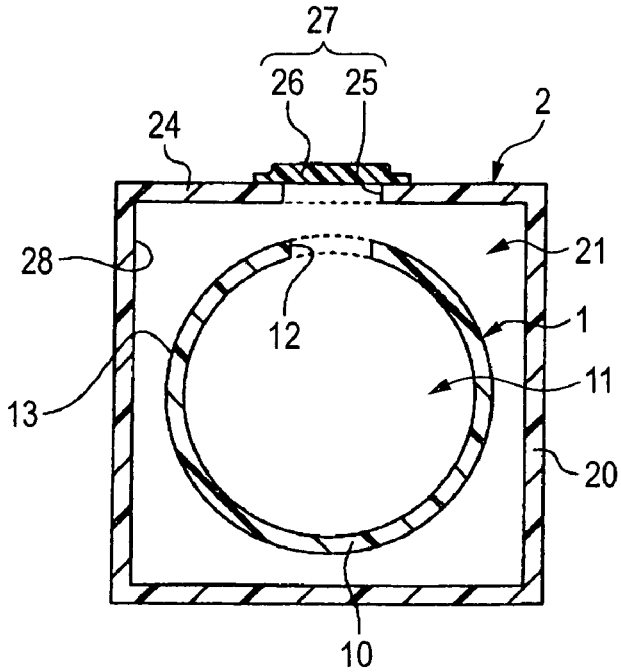
FIG. 2 is a sectional view schematically showing the behavior, in which the muffler duct of the embodiment is cut in parallel with the radial direction of a duct body.

As shown in FIGS. 1 and 2, the muffler duct of the embodiment includes a duct body 1 and a resonance box 2. The duct body 1 has a generally cylindrical shape. The inside and the outside of the duct body 1 are partitioned by a circumferential wall 10. The resonance box 2 has a generally rectangular box shape. The inside and the outside of the resonance box 2 are partitioned by a partition wall 20.

The duct body 1 has its axial portion housed along the longitudinal direction of the resonance box 2 in the inside 21 of the resonance box 2. In a pair of partitioning side walls 22 as positioned at the longitudinal terminal ends of the partition wall 20 of the resonance box 2, specifically, there are formed mounting openings 23, which are individually formed into circular through holes. The duct body 1 is housed at its axially central portion in the inside 21 of the resonance box 2. The duct body 1 has its one axial end portion exposed to the outside through one mounting opening 23. The other axial end portion of the duct body 1 is exposed to the outside through the other mounting opening 23. Of each of the partitioning side walls 22, the circumferential edge portion of the mounting opening 23 is fixed on the circumferential wall 10 of the duct body 1.

In the circumferential wall 10 of the duct body 1, there is formed a communication opening 12, which has a generally circular through hole. As a result, the inside 11 of the duct body 1 and the inside 21 of the resonance box 2 directly communicate with each other through that communication opening 12.

In the partition wall 20 of the resonance box 2, a gas vent opening 25 having the shape of a rectangular through hole is formed in a confronting partition 24 confronting the communication opening 12. This gas vent opening 25 is covered with a gas-permeable member 26 made of nonwoven cloth of a resin. A gas vent opening portion 27 composed of the gas vent opening 25 and the gas-permeable member 26 is formed in the confronting partition 24 at a position to confront the communication opening 12.

The duct body 1 had an axial length of 2,000 mm, an internal radius (or a radius) of 40 mm and a thickness of 3 mm. The communication opening 12 had a radius of 20.5 mm. The resonance box 2 had a thickness of 3 mm and a volume (i.e., the volume of the space defined by an inner periphery 28 of the resonance box 2 and an outer circumference 13 of the duct body 1) of 1.417 L. The communication opening 12 had a length (i.e., the thickness of the duct body 1) of 3 mm. The gas vent opening 25 had an open area of 4,900 $mm^2$. When the pressure difference between the inside and the outside of the resonance box 2 was 98 Pa, the gas-permeable member 26 had an air vent of 3,500 $m^3/h$. The distance between the gas vent opening 25 and the communication opening 12 was 5 mm.

(Comparison 1)

Figure 3:
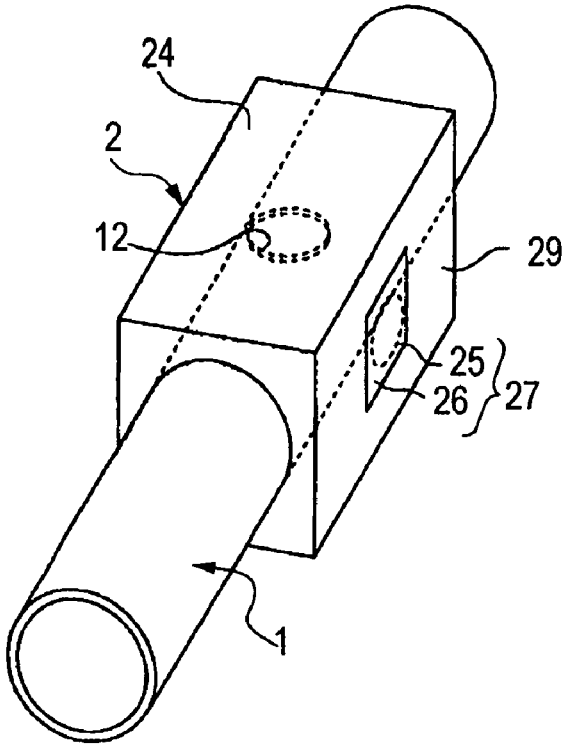
FIG. 3 is a perspective view expressing the muffler duct of Comparison 1 schematically.

The muffler duct of Comparison 1 is identical to the muffler duct of the embodiment but for the position of the gas vent opening. A perspective view expressing the muffler duct of Comparison 1 schematically is shown in FIG. 3. A sectional view schematically expressing the behavior, in which the muffler duct of Comparison 1 is cut in parallel with the radial direction of the duct body, is shown in FIG. 4.

Figure 4:
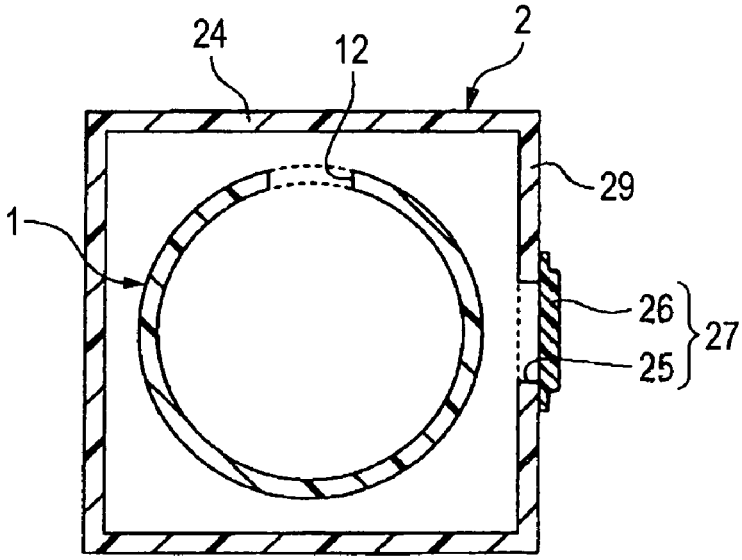
FIG. 4 is a sectional view schematically showing the behavior, in which the muffler duct of Comparison 1 is cut in parallel with the radial direction of a duct body.

As shown in FIGS. 3 and 4, the gas vent opening portion 27 in the muffler duct in Comparison 1 is formed in a general partition wall 29 adjacent to the confronting partition 24. The gas vent opening 25 in the muffler duct of Comparison 1 has the same shape as that of the gas vent opening 25 in the muffler duct of the embodiment. Moreover, the gas-permeable member 26 in the muffler duct of Comparison 1 is identical to the gas-permeable member 26 in the muffler duct of the embodiment.

(Comparison 2)

Figure 5:
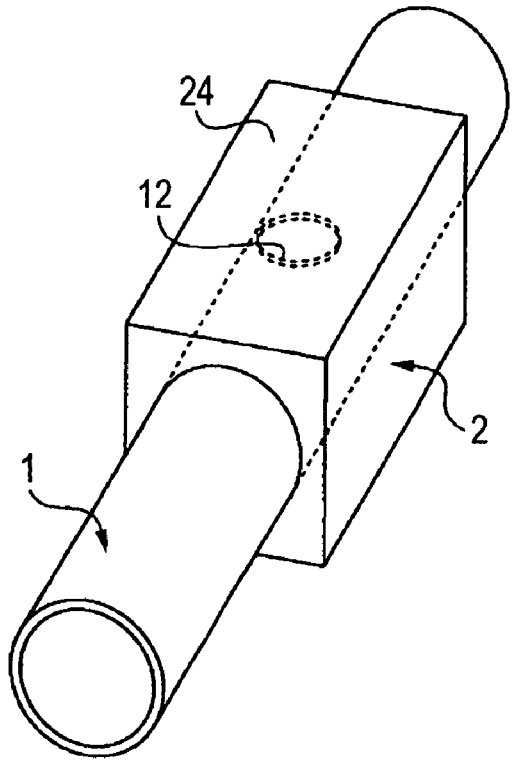
FIG. 5 is a perspective view expressing the muffler duct of Comparison 2 schematically.

The muffler duct of Comparison 2 is identical to the muffler duct of the embodiment but for the absence of the gas vent opening portion. A perspective view expressing the muffler duct of Comparison 2 schematically is shown in FIG. 5. A sectional view schematically expressing the behavior, in which the muffler duct of Comparison 2 is cut in parallel with the radial direction of the duct body, is shown in FIG. 6.

Figure 6:
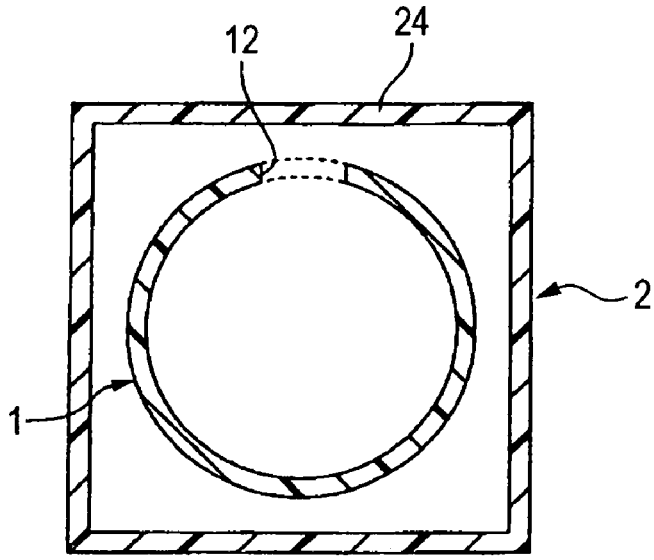
FIG. 6 is a sectional view schematically showing the behavior, in which the muffler duct of Comparison 2 is cut in parallel with the radial direction of a duct body.

As shown in FIGS. 5 and 6, the muffler duct of Comparison 2 does not have the gas vent opening portion, but the communication opening 12 has its outer side shielded by the confronting partition 24.

(Comparison 3)

The duct of Comparison 3 is composed of only the duct body having no communication opening. The duct body in the duct of Comparison 3 is identical to the duct body in the muffler duct of the embodiment but for the absence of the communication opening.

(Comparison 4)

Figure 7:
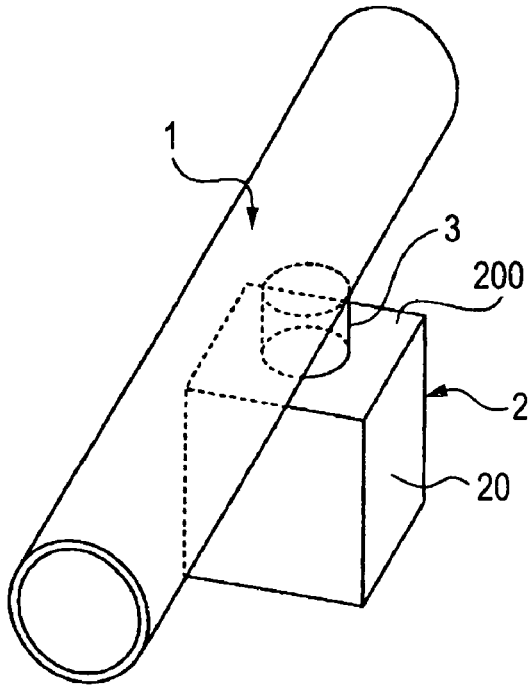
FIG. 7 is a perspective view expressing the muffler duct of Comparison 4 schematically.

The muffler duct of Comparison 4 is identical to the muffler duct of the embodiment but for the presence of a communicating tube and that the resonance box is a generally cubic box shape. A perspective view expressing the muffler duct of Comparison 4 schematically is shown in FIG. 7. A sectional view schematically expressing the behavior, in which the muffler duct of Comparison 4 is cut in parallel with the radial direction of the duct body, is shown in FIG. 8.

Figure 8:
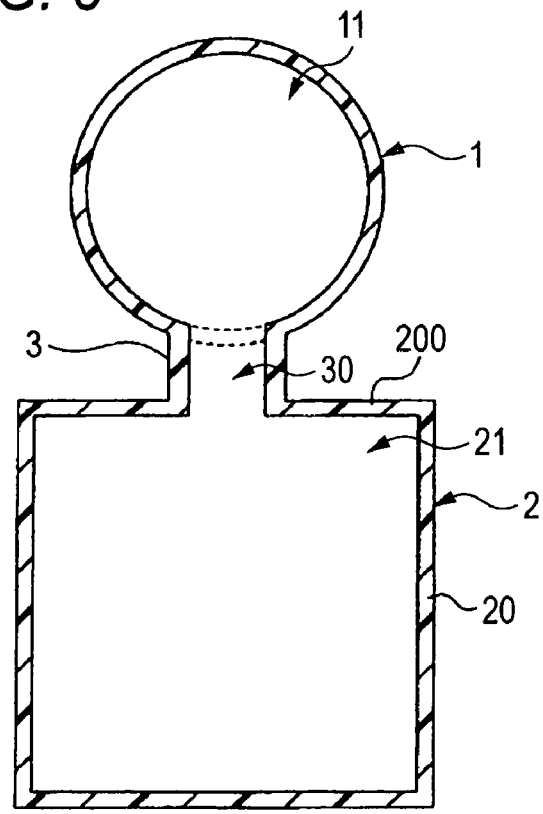
FIG. 8 is a sectional view schematically showing the behavior, in which the muffler duct of Comparison 4 is cut in parallel with the radial direction of a duct body.

As shown in FIGS. 7 and 8, the muffler duct of Comparison 4 is composed of the duct body 1 and the resonance box 2. The duct body 1 has the same shape as that of the duct body 1 in the muffler duct of the embodiment. The resonance box 2 has a generally cubic box shape. The inside 21 and the outside of the resonance box 2 is partitioned from the outside by the partition wall 20. A generally cylindrical communicating tube 3 is formed integrally with a communication partition 200 or the partition wall 20. The inside 30 of the communicating tube 3 and the inside 21 of the resonance box 2 communicate with each other. The end portion of the communicating tube 3 on the side opposite to the resonance box 2 is jointed to the duct body 1. The inside 30 of the communicating tube 3 and the inside 11 of the duct body 1 communicate with each other. As a result, the inside 11 of the duct body 1 and the inside 21 of the resonance box 2 communicate with each other through the communicating tube 3.

The communicating tube 3 had an internal radius (or a radius) of 20.5 mm, and the communicating tube 3 had a length of 347 mm. The resonance box 2 had a volume of 1.405 L.

Figure 9:
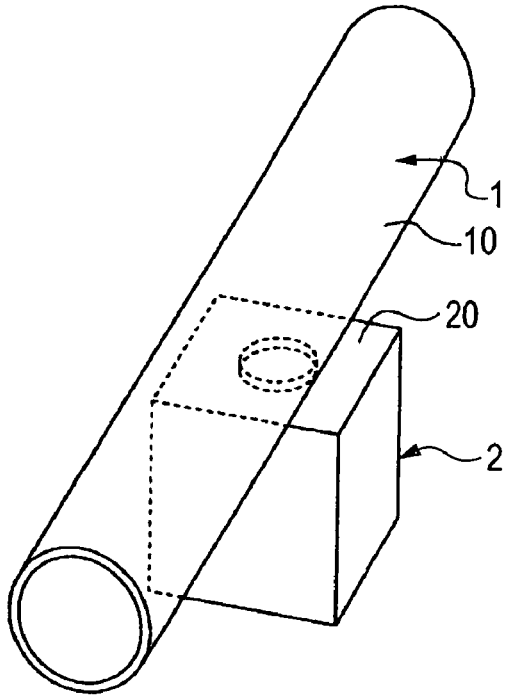
FIG. 9 is a perspective view expressing the muffler duct of Comparison 5 schematically.

The muffler duct of Comparison 5 is identical to the muffler duct of Comparison 4 but for the absence of the communicating tube. A perspective view expressing the muffler duct of Comparison 5 schematically is shown in FIG. 9. A sectional view schematically expressing the behavior, in which the muffler duct of Comparison 5 is cut in parallel with the radial direction of the duct body, is shown in FIG. 10.

The muffler duct of Comparison 5 presents an example, in which the communicating tube 3 is eliminated from the muffler duct of Comparison 3 and in which the resonance box 2 is directly fixed to the duct body 1.

Figure 10:
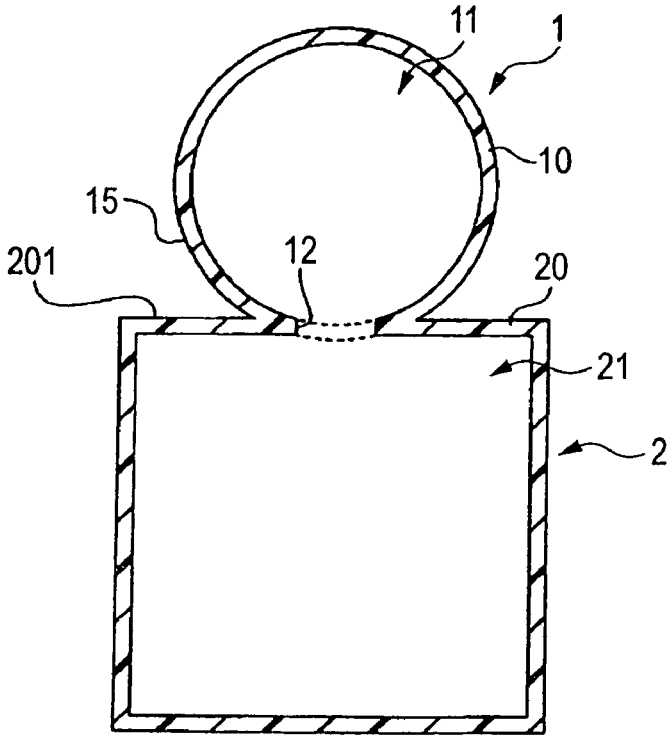
FIG. 10 is a sectional view schematically showing the behavior, in which the muffler duct of Comparison 5 is cut in parallel with the radial direction of a duct body.

As shown in FIGS. 9 and 10, the duct body 1 and the resonance box 2 in the muffler duct of Comparison 5 are integrated by jointing the partition wall 20 and the circumferential wall 10. The outer periphery 201 of the partition wall 20 and the outer circumference 15 of the circumferential wall 10 confront each other. Specifically, the duct body 1 is arranged on the outside of the resonance box 2.

In the joint portion between the circumferential wall 10 and the partition wall 20, there is formed the communication opening 12, which is formed to have a generally circular through hole. The inside 11 of the duct body 1 and the inside 21 of the resonance box 2 communicate directly with each other through that communication opening 12.

The communication opening 12 had a radius of 20.5 mm. The resonance box 2 had a thickness of 3 mm, and the resonance box 2 had a volume of 1.405 L. The communication opening 12 had a length (or the thickness of the duct body 1) of 3 mm.

(Comparison 6)

Figure 11:
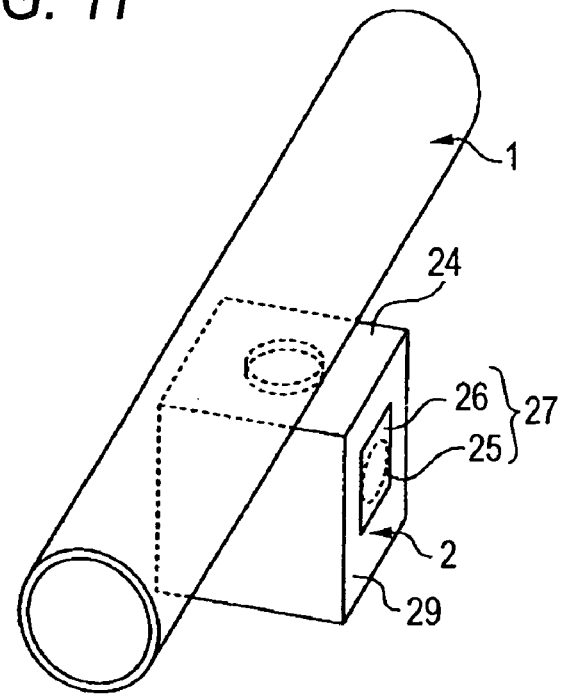
FIG. 11 is a perspective view expressing the muffler duct of Comparison 6 schematically.

The muffler duct of Comparison 6 is identical to the muffler duct of Comparison 5 but for the presence of the communication opening. A perspective view expressing the muffler duct of Comparison 6 schematically is shown in FIG. 11. A sectional view schematically expressing the behavior, in which the muffler duct of Comparison 6 is cut in parallel with the radial direction of the duct body, is shown in FIG. 12.

The muffler duct of Comparison 6 presents an example, in which the muffler duct of Comparison 6 is provided with the communication opening.

Figure 12:
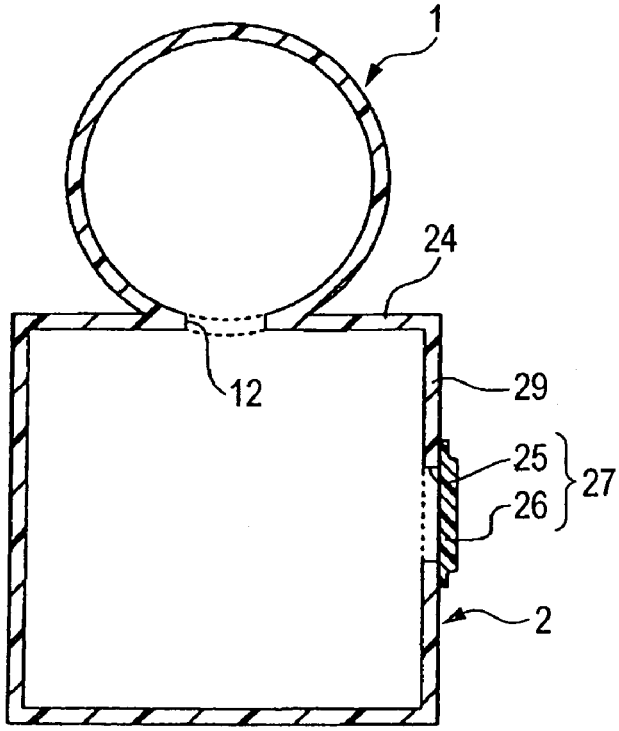
FIG. 12 is a sectional view schematically showing the behavior, in which the muffler duct of Comparison 6 is cut in parallel with the radial direction of a duct body.

As shown in FIGS. 11 and 12, the gas vent opening portion 27 in the muffler duct of Comparison 6 is formed in the general partition wall 29 adjacent to the confronting partition 24. Here, the confronting partition 24 indicates the partition wall 20 confronting the communication opening 12 as in the muffler duct of the embodiment. The gas vent opening 25 in the muffler duct of Comparison 6 has the same shape as that of the gas vent opening 25 in the muffler duct of the embodiment. The gas-permeable member 26 in the muffler duct of Comparison 6 is identical to the gas-permeable member 26 in the muffler duct of the embodiment.

(Muffling Evaluation Tests)

Figure 13:
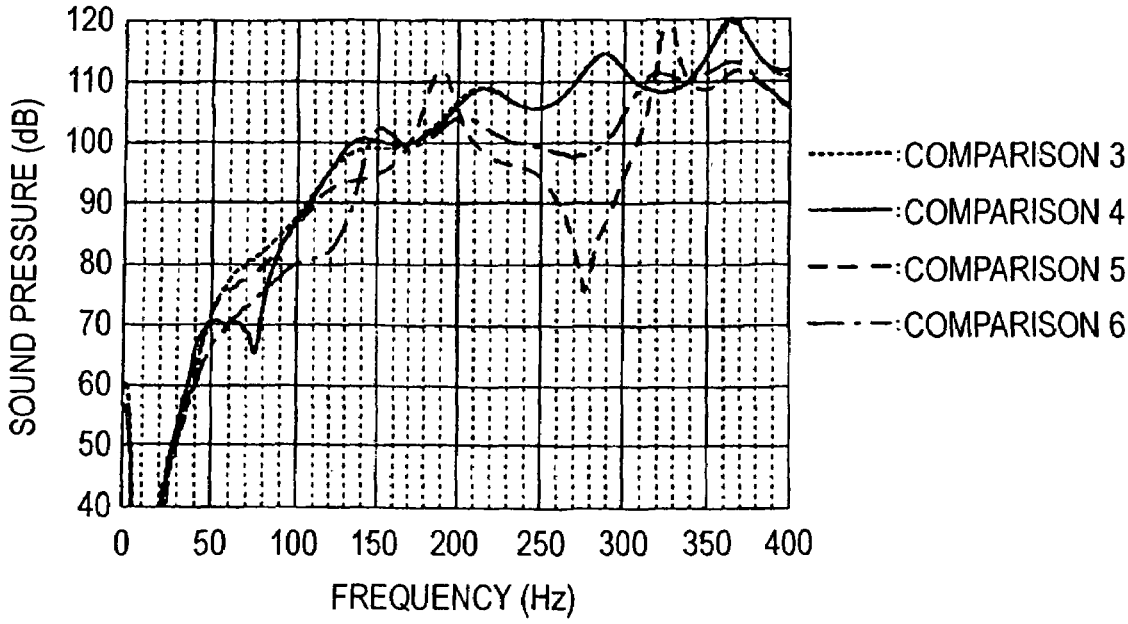
FIG. 13 is a graph plotting the muffling performances of the muffler ducts of Comparisons 3 to 6.
Figure 14:
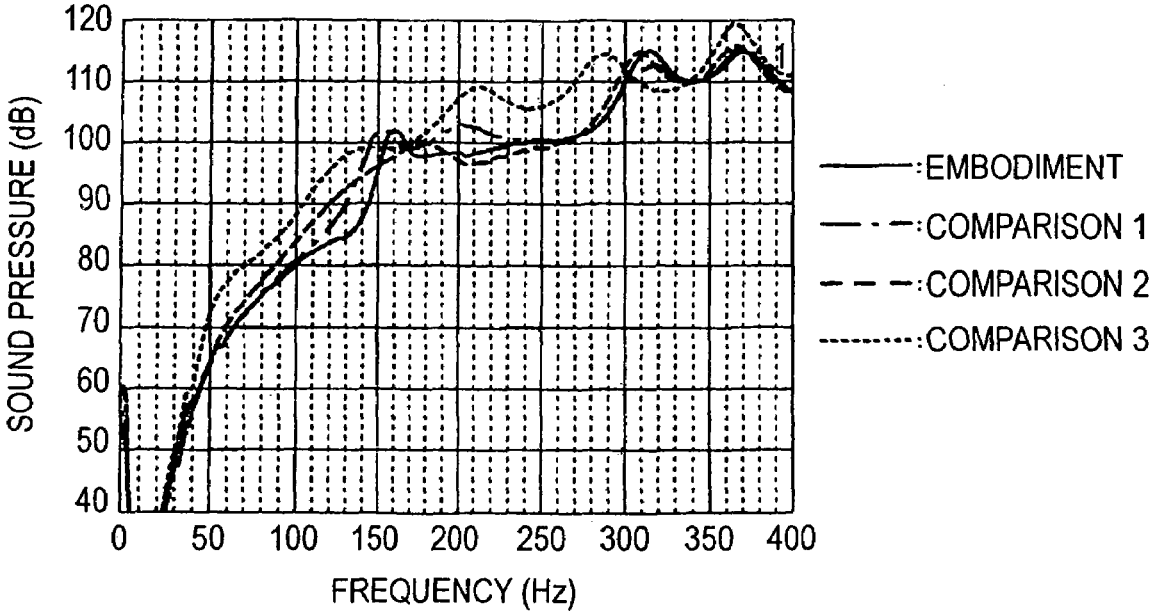
FIG. 14 is a graph plotting the muffling performances of the muffler ducts of the embodiment and Comparisons 1 to 3.

The muffling performances of the muffler duct of the embodiment and the muffler ducts of Comparisons 1 to 5 were evaluated. Specifically, a speaker was arranged at one end portion of the duct body of each muffler duct, and the noises of a frequency of 10 Hz to 800 Hz generated by the speaker were transmitted to the inside of the duct body. On the other hand, a speaker vibration device, in which a microphone was arranged on the other end portion of the duct body in each muffler duct, was used to measure the frequency (Hz) and the sound pressure (dB) of the noises having propagated through the duct body. Graphs plotting the muffling performances of the individual muffler ducts are plotted in FIGS. 13 and 14. FIG. 13 is a graph plotting the muffling performances of the muffler ducts of Comparisons 3 to 6. FIG. 14 is a graph plotting the muffling performances of the muffler ducts of the embodiment and Comparisons 1 to 3.

As seen from FIG. 13, the muffler ducts of Comparisons 4 to 6 having the resonance boxes can make the noises (or the noises of 50 to 100 Hz) of the low frequency lower than those of Comparison 3 having no resonance box.

The muffler duct of Comparison 4 has a radius r of the communicating tube of 20.5 mm, a length L of the communicating tube of 347 mm, and a volume V of the resonance box of 1.405 L. Therefore, the resonance frequency F to be calculated on the basis of Formula 1 is about 90 Hz. FIG. 13 indicates that the muffler duct of Comparison 4 is lower in the noises near 90 Hz than the duct of Comparison 3.

On the other hand, the muffler duct of Comparison 5 has a radius r of the communicating tube of 20.5 mm, a length L of the communication opening of 3 mm, and a volume V of the resonance box of 1.405 L. Therefore, the resonance frequency F to be calculated on the basis of Formula 1 is about 290 Hz. FIG. 13 indicates that the muffler duct of Comparison 5 is lower in the noises or the resonance frequency near 290 Hz than the duct of Comparison 3.

As shown in FIG. 13, however, the muffler duct of Comparison 5 makes the noises near 50 to 300 Hz lower than those of the duct of Comparison 3. From this result, it is understood that the muffler duct having no communicating tube, i.e., the muffler duct, in which the inside of the duct body and the inside of the resonance box communicate directly with each other, can reduce not only the noises near the resonance frequency F but also the noises of a low frequency over a wide range.

Like the muffler duct of Comparison 5, the muffler duct of Comparison 6 has the resonance frequency F of about 290 Hz. As seen from FIG. 13, this muffler duct reduces, like the muffler duct of Comparison 5, the noises near 290 Hz but also the noises near 50 to 300 Hz. From this result, it is understood that the muffler duct having the inside of the duct body and the inside of the resonance box communicating directly with each other can reduce the noises of the low frequency over the wide range.

Moreover, the muffler duct of Comparison 6 lowers the noises near 50 to 170 Hz more than the muffler duct of Comparison 5. Moreover, the muffler duct of Comparison 6 has such a less frequency range than the muffler duct of Comparison 5 that the sound pressure level abruptly rises. From this result, it is understood that the muffler duct of Comparison 6 having the gas vent opening portion can suppress the anti-resonance phenomenon.

The muffler ducts of the embodiment and Comparisons 1 and 2 have a radius r of the communicating tube of 20.5 mm, a length L of the communication opening of 3 mm, and a volume V of the resonance box of 1.417 L. Therefore, the resonance frequency F to be calculated on the basis of Formula 1 is about 290 Hz.

FIG. 14 indicates that the muffler ducts of the embodiment and Comparison 1 and 2 make the noises of the resonance frequency near 290 Hz less than the duct of Comparison 3. Moreover, it is understood from FIG. 14 that the muffler ducts of the embodiment and Comparisons 1 and 2 can also reduce the noises near 290 Hz (or the noises near the resonance frequency F) but also the noises of the low frequency over the wide range. From this result, it is understood that the muffler duct having the inside of the duct body and the inside of the resonance box communicating directly with each other can reduce the noises of the low frequency over the wide range.

According to FIG. 14, moreover, the muffler duct of the embodiment makes the noises of 50 to 300 Hz (or the noises of the low frequency) less as a whole than the muffler ducts of Comparisons 1 and 2. The muffler duct of the embodiment and the muffler ducts of Comparison 1 and 2 are different only in the forming positions of the gas vent opening portion. It is understood from this result that the noises of the low frequency can be reduced over a wider range by forming the gas vent opening portion in the partition wall at a position to confront the communication opening.

It is understood from these results that the noises of the low frequency can be reduced over the wide range by the muffler duct of the invention.

What is claimed is:

1. A muffler duct comprising:

a duct body of a generally cylindrical shape having an inside and outside defined by a circumferential wall; and a resonance box of a box shape having an inside and outside defined by a partition wall and mounted on said duct body, wherein a gas vent opening portion including a gas vent opening having a through hole shape and a gas-permeable member having a gas vent passage of a labyrinth shape for covering said gas vent opening is formed in said partition wall;

wherein said resonance box houses a portion of said duct body therein;

wherein said circumferential wall has a communication opening of a through hole opened in said resonance box, and wherein the communication opening is open and unobstructed;

wherein the inside of said duct body and the inside of said resonance box communicate directly with each other through said communication opening; and wherein said gas vent opening portion is formed in said partition wall at a position to confront said communication opening.

2. A muffler duct as set forth in claim 1, wherein said resonance box encloses said duct body in the circumferential direction at an axial portion of said duct body.

3. A muffler duct as set forth in claim 1, wherein said resonance box extends along the axial direction of said duct body.

4. A muffler duct as set forth in claim 1, wherein said resonance box has a generally rectangular box shape.

5. A muffler duct as set forth in claim 1, wherein a gas-permeability of said gas-permeable member under a pressure difference of 98 Pa between the inside and the outside of the resonance box is 6,000 $m^3$/h or less per 1 $m^2$.

6. A muffler duct as set forth in claim 1, wherein a gas-permeability of said gas-permeable member under a pressure difference of 98 Pa between the inside and the outside of the resonance box is less than 4,200 $m^3$/h per 1 $m^2$.

7. A muffler duct as set forth in claim 1, wherein a gas-permeability of said gas-permeable member under a pressure difference of 98 Pa between the inside and the outside of the resonance box is more than 0 $m^3$/h end less than 3,000 $m^3$/h per 1 $m^2$.

8. A muffler duct comprising:

a cylindrical duct body having a circumferential wall; and a resonance box surrounding a section of the duct body, wherein the resonance box has side walls and opposed end walls, the duct body passes through the opposed end walls of the resonance box such that the resonance box extends in an axial direction of the duct body, the side walls of the resonance box, which are walls other than the opposed end walls, are spaced apart from the circumferential wall of the duct body, such that a space separates the circumferential wall of the duct body from the side walls of the resonance box about the entire periphery of the duct body, an open, unobstructed and unfiltered communication opening is formed through the duct body, and the communication opening allows communication between an inside of the duct body and an inside of the resonance box, a gas vent opening is formed through the partition wall such that an inside of the resonance box can communicate with an outside of the resonance box through the gas vent opening, the gas vent is covered by a gas-permeable member, and the gas vent opening directly faces and is aligned with the communication opening.

9. A muffler duct as set forth in claim 8, wherein the resonance box has a generally rectangular box shape.

10. A muffler duct as set forth in claim 8, wherein a gas-permeability of the gas-permeable member under a pressure difference of 98 Pa between the inside end the outside of the resonance box is 6,000 $m^3$/h or less per 1 $m^2$.

11. A muffler duet as set forth in claim 8, wherein a gas-permeability of the gas-permeable member under a pressure difference of 98 Pa between the inside and the outside of the resonance box is less tan 4,200 $m^3$/h per 1 $m^2$.

12. A muffler duct as set forth in claim 8, wherein a gas-permeability of the gas-permeable member under a pressure difference of 98 Pa between the inside and the outside of the resonance box is mare than 0 $m^3$/h and less than 3,000 $m^3$/h per 1 $m^2$.

* * * * *